United States Patent [19]

McKay

[11] Patent Number: 4,698,947

[45] Date of Patent: Oct. 13, 1987

[54] CONCRETE WALL FORM TIE SYSTEM

[76] Inventor: Harry McKay, 16 Megal Avenue, West Hill, Ontario, Canada, M1E 4A7

[21] Appl. No.: 929,887

[22] Filed: Nov. 13, 1986

[51] Int. Cl.[4] ..... E04B 2/86; E04B 2/32

[52] U.S. Cl. ..... 52/309.12; 52/309.11; 52/426; 52/562; 52/564; 52/713

[58] Field of Search ..... 52/309.11, 309.12, 426, 52/427, 562, 564, 713

[56] References Cited

U.S. PATENT DOCUMENTS

| | | | |
|---|---|---|---|
| 1,453,557 | 5/1923 | Wagner | 52/426 |
| 1,905,167 | 4/1933 | Graef | 52/426 |
| 1,911,626 | 5/1933 | Larzelere | 52/426 X |
| 2,029,082 | 1/1936 | Odam | 52/713 X |
| 2,817,965 | 12/1957 | Angeline | 52/562 |
| 2,851,874 | 9/1958 | Carlson | 52/426 X |
| 3,089,570 | 5/1963 | O'Neil, Jr. | 52/713 |
| 3,618,993 | 11/1971 | Platte | 52/713 |
| 3,788,020 | 1/1974 | Gregori | 52/309.12 |
| 4,516,372 | 5/1985 | Grutsch | 52/309.12 |

FOREIGN PATENT DOCUMENTS

| | | | |
|---|---|---|---|
| 924922 | 4/1973 | Canada | 52/426 |
| 2255810 | 5/1974 | Fed. Rep. of Germany | 52/562 |
| 2328098 | 12/1974 | Fed. Rep. of Germany | 52/309.12 |
| 2433388 | 1/1976 | Fed. Rep. of Germany | 52/562 |
| 959821 | 10/1949 | France | 52/564 |

*Primary Examiner*—Alfred C. Perham

*Attorney, Agent, or Firm*—Cullen, Sloman, Cantor, Grauer, Scott and Rutherford

[57] ABSTRACT

An insulated wall is made of spaced-apart, parallel, foamed plastic sheets between which concrete is poured to form a concrete wall faced with such sheets. Before the concrete is poured, these sheets, which comprise numerous, small panels that are interconnected edge-to-edge are secured together by numerous ties. Each of the ties is formed of a pair of parallel, vertically-elongated, thin, rigid, sheet metal plates that are connected together by thin, horizontally-elongated sheet metal strips whose opposite ends are connected to their respective plates. Each plate is snugly inserted within aligned edge pockets formed in the abutting edges of adjacent panels so that the plates assist in aligning and interconnecting the adjacent panels. The edge pockets have vertically-elongated slots that open at the interior faces of the panels, and the plates each have a central, vertically-elongated embossment snugly fitted within and exposed through its respective slots for aligning the panel end pockets and for securement to the ends of its respective strips. In addition, the plates have tooth-like strike-outs which embed within the pocket walls to hold the panels from moving due to the hydrostatic forces during the pouring of the concrete.

13 Claims, 7 Drawing Figures

CONCRETE WALL FORM TIE SYSTEM

BACKGROUND OF INVENTION

Insulated, composite concrete walls formed of a concrete core, covered with sheets of foam plastic material, have been produced by utilizing the sheets to form molds for casting the concrete. That is, a pair of parallel, spaced-apart sheets provide a space or mold into which concrete may be poured. The foam plastic sheets and the concrete form a composite wall when the concrete is cured.

In this type of construction, the sheets are each formed of a number of smaller panels which are interconnected, edge-to-edge, to provide the large sheet. The panels may be interlocked by tongue-and-groove interconnections. In addition, the panels have been interconnected by the use of ties which comprise a pair of spaced apart plates that are connected by strips. Each of the plates is fitted into aligned edge pockets formed in adjacent panel edges to connect the panels. The strips extend across the space between the sheets to connect the sheets.

The ties hold the panels in alignment to form the parallel sheets and hold the sheets in parallelism during the casting of the concrete. Further, the ties serve to reinforce the cast, composite wall structure. An example of this type of construction is illustrated in Canadian Pat. No. 1,187,671, issued May 28, 1985 to Hunter.

The prior ties are of limited strength and are subject to damage by heat due to fires. In addition, the prior ties are inadequate to completely prevent the panels from moving as a result of the substantial hydrostatic forces produced during the pouring of the concrete.

Consequently, the invention herein relates to an improved tie system for aligning and positioning the sheet-forming panels, immobilizing the panels against "floating" or movement due to hydrostatic pressures, and serving to better resist and dissipate any undue heat applied to the wall construction.

SUMMARY OF INVENTION

This invention contemplates a tie system which includes a pair of spaced-apart sheet metal plates that are interconnected by sheet metal strips. The plates, which are vertically elongated, have flattened, U-shaped, bent central portions or embossments extending along their full height. These embossments have struck-out, flattened loops formed in their surfaces to provide slots at the upper and lower edges of the loops. The strips, which have downwardly bent legs, extend between the plates with their legs inserted through the upper and lower slots of a loop. The legs are interconnected to their loops by means of a simple mechanical fastener, such as a detent struck out of the loop material and engaging a corresponding opening in the adjacent leg portion.

The elongated, narrow central embossments, form a rigidifying central spine for each plate. The plates are sized to snugly fit within end to end aligned pockets formed in adjacent panel edges. These pockets each have a slot which opens at the inner face of the panel, that is, the slot opens towards the opposing panel. The embossments snugly fit with the aligned slots of a pair of vertically aligned pockets for aligning the adjacent panel edges. In addition, the exposed embossments grip the poured concrete to assist in interlocking the concrete to the panels.

This invention also contemplates providing tooth-forming, struck-out tabs in the embossment portion of each plate, which tabs can be manually pushed into the adjacent panel surfaces for embedding therein. This rigidly secures the tie plates to the plastic panels to prevent the panels from floating or moving out of position during the pouring of the concrete due to the hydrostatic forces produced by the concrete.

This tie system rigidly maintains the spacing between the opposed sheets, which are formed by the numerous edge to edge connected panels, during the pouring and the curing of the concrete. Simultaneously, the system holds the panels immovably in aligned edge-to-edge relationship during the pouring. Thereafter, the system helps interlock the panels to the concrete to produce the composite wall structure.

An object of this invention is to provide a tie system for forming composite concrete walls, which system is inexpensive, easy to utilize, and wich can be manually assembled on the job without special tools by simply inserting the plates into the panel pockets and then inserting the tie strips whose legs automatically lock to the plates. This tie system can be assembled rapidly by unskilled labor using only a screwdriver or the like type of tool.

In addition, an object is to provide a tie system which is extremely rigid, so as to resist displacement of the panels during the time the concrete is poured.

Still another object of this invention is to provide a tie system which tends to dissipate heat through the wall. Thus heat caused by fire or undue ambient heat is dissipated, which makes the wall more resistent to heat destruction.

These and other objects and advantages will become apparent upon reading the following description, of which the attached drawings form a part.

DETAILED DESCRIPTION

Figure 1:
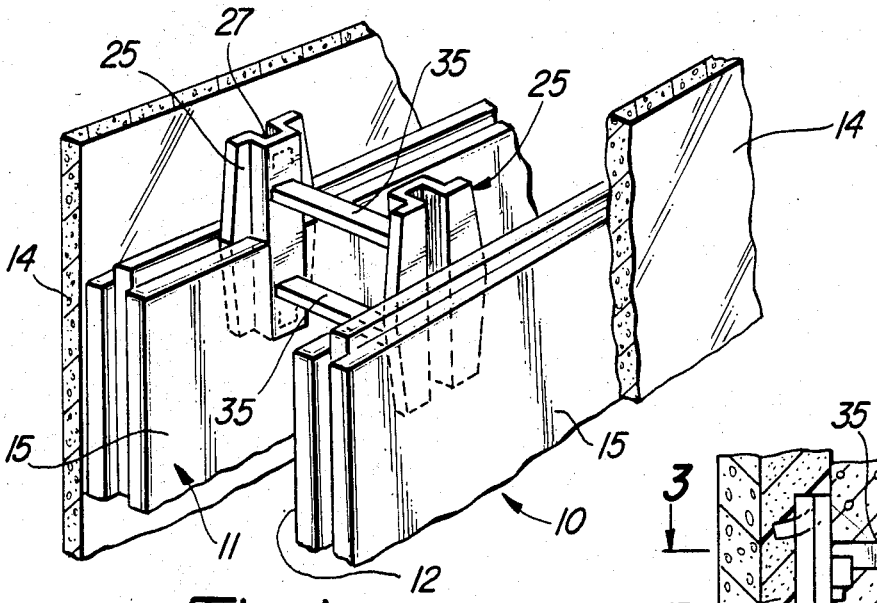
FIG. 1 is a perspective view of a single tie connecting spaced panels together.
Figure 2:
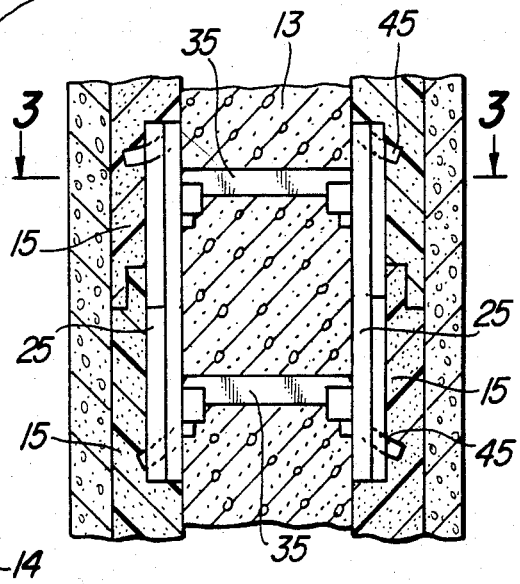
FIG. 2 is a cross-sectional, elevational view of a fragment of a composite wall construction with a tie in position.

FIG. 1 illustrates a pair of foamed plastic sheets 10 and 11 which are spaced apart to form a mold. Concrete is poured into the space 12 and is cured so as to form a composite wall construction made of a concrete core 13 (see FIG. 2) with sheets 10 and 11. An exterior wall covering 14 formed of gypsum board or other construction material may be applied to either or both of the exposed surfaces of the foamed plastic sheets.

The foamed plastic sheets are made of a number of small panels 15 that are preformed using any suitable commercially available plastic material, such as polyurethane, polyethylene and the like. The particular plastic selected depends upon availability, cost and suitability for the function. Since there are many plastics that may be used, and the particular plastic material is not critical to this invention, determination of the particular plastic material can be made by those skilled in the art.

Figure 4:
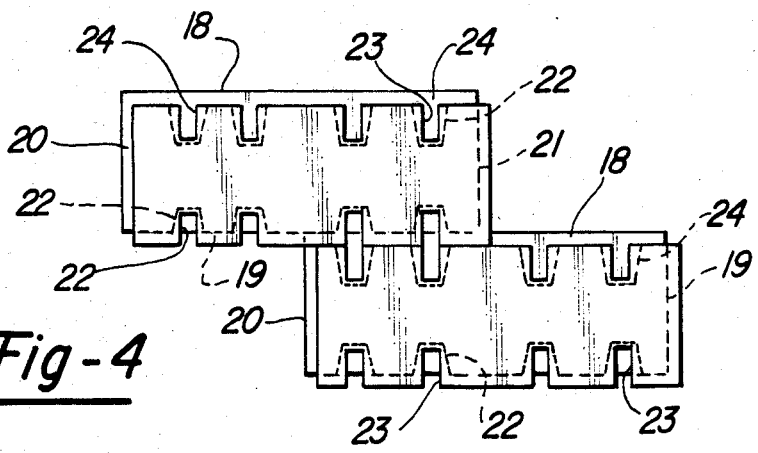
FIG. 4 is a reduced scale, elevational view of a pair of panels aligned, edge-to-edge, to form a portion of the wall-forming plastic sheet.

Each of the numerous smaller panels 15 (see FIG. 4) is provided with horizontal edge tongues 18 which interfit within grooves 19 in the adjacent edges of the adjacent panels. The vertical edges are also provided with tongues 20 which interfit within grooves 21 in adjacent panels. Further, each of the panels is provided with a number of spaced-apart edge pockets 22 which have openings or slots 23 formed at the interfaces of the panels, i.e. the faces that face toward opposing panels. The ends 24 of the pockets are also open. The pockets on one panel are vertically aligned with the pockets on the next adjacent panel, as shown in FIG. 4, so that their respective slots are continuous.

A tie plate 25 may be inserted within each of the aligned pairs of edge pockets 22. These tie plates are each formed of thin, rigid sheet metal material, as for example, 20–22 gauge galvanized steel. The central portions of the plates are bent into a channel-shaped spine or embossment 27 that extends the height of the plate. These spines or embossments are sized to substantially fill or snugly fit within the aligned slots 23 of the pockets. Thus, they assist in aligning the pockets and consequently the panels.

The portions of the tie plates at each side of the spine or embossment 27 are formed into wings or side portions 28 whose edges are tapered (see FIGS. 1 and 5) so as to snugly fit within the correspondingly tapered edge pockets.

Each of the central spines or embossments 27 has flat, struck-out loops 30. Since the loops are spaced inwardly of the plates, they provide an upper slot 31 and a lower slot 32 in the embossments.

Tie strips 35 extend between the plates. These are formed of thin, rigid sheet metal, such as galvanized steel of the type used for the plates. The tie strips have their side edges bent longitudinally to provide side flanges 36, so that the strips are U-shaped in cross-section along their lengths. The opposite ends of the strips are bent into downwardly depending legs 38 which tightly fit into the upper and lower slots 31 and 32 of the flat struck out loops 30 in the plates.

Figure 3:
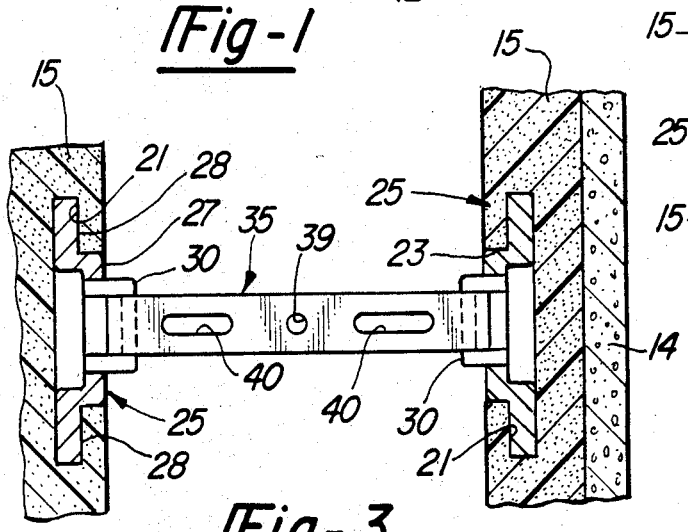
FIG. 3 is a cross-sectional, plan view, taken as if in the direction of arrows 3—3 of FIG. 2, of a pair of wall-forming sheets fastened together by a tie.

Round holes 39 and elongated slots or openings 40 are formed in the strip 35 for interlocking with the concrete. Either the holes or the slots may be used separately or they may be used together as illustrated in FIG. 3.

In order to interlock the legs 38 of the strips 35 with the plates 25, struck out detents 42 are formed in the loops 30. These detents tightly interlock with holes 43 or corresponding detents formed in the legs 38.

In operation, the assembler lays a horizontal row of panels and then another row of panels above the first row, offset in the manner similar to laying bricks. After the lowermost row or course is laid, plates 25 are inserted in the pockets. When the next panel row is laid, their pockets are fitted over the plates while the respective tongues 18 and grooves 19 are interfitted. The tapered or sloped edges of the plates and the substantially uniform width spine or embossment engaging the slots 23 assist to align and rigidly secure together, the adjacent panels to form the large sheet.

In order to maintain the spacing between the sheets as they are being assembled from the panels, the assembler applies the strips 35 by inserting the legs 38 of the strips into the slots 31 and 32 of the loops 30 on the plates. As the strips are pushed into place, the detents 42 automatically interlock with the holes 43 or corresponding detents to mechanically lock the strips to the plates and prevent disassembly.

Figure 5:
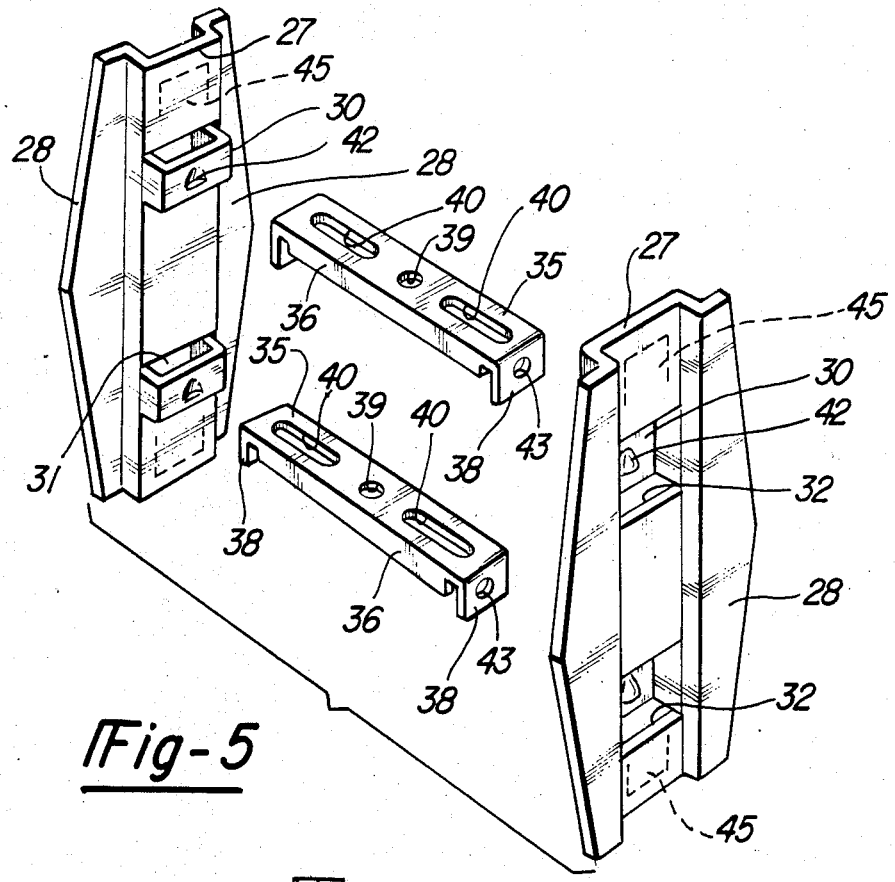
FIG. 5 is an enlarged, disassembled, perspective view of a tie.
Figure 6:
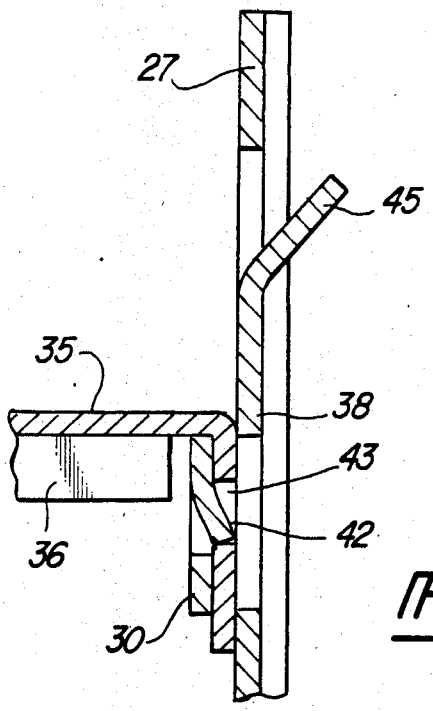
FIG. 6 is an enlarged, fragmentary, cross-sectional view of a portion of a tie showing the connection between the tie plate, a tie strip, and a tooth-forming tab bent for engagement with the adjacent panel portion.

The plates are also provided with struck out tabs 45 which form teeth. As illustrated in FIG. 5, a line of severance is formed on three sides of tabs 45 located at the upper and lower portions of the embossment of each plate. The unsevered fourth side provides a hinge-like portion. When the plate is assembled within the panel pockets, the assembler, by pushing with a screwdriver or similar instrument, bends the tabs so that they embed within the foam plastic panel portion which they overlap. This locking effect rigidifies the assembly and, holds the panels from "floating" or becoming displaced due to the substantial hydrostatic pressure encountered when the concrete is poured into the space between the sheets.

Figure 7:
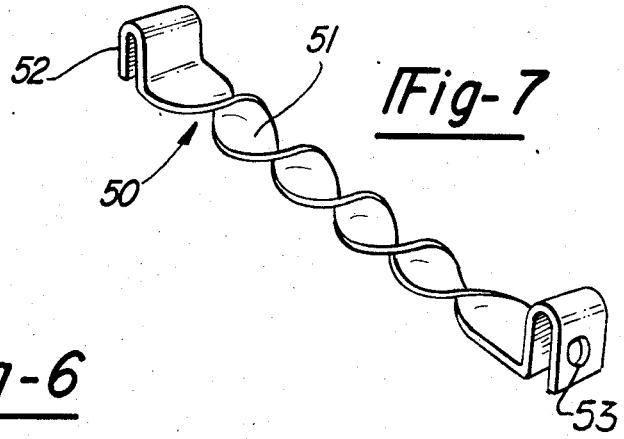
FIG. 7 is a modified form of tie strip.

FIG. 7 illustrates a modified strip 50 which is made of sheet metal that is repeatedly twisted about a central axis to form 360° twists 51. The opposite ends are bent into U-shaped legs 52 that are provided with detent-receiving holes 53. The strips may be assembled upon the plates in the same manner as described above. However, because of their twisted formation, they provide considerable interengagement or interlocking with concrete and also are able to dissipate heat faster within the surrounding concrete.

This invention may be further developed within the scope of the following claims.

Accordingly, it is desired that the foregoing description of an operative embodiment be considered as illustrative. Having fully described an operative embodiment of this invention, I now claim:

1. A concrete wall form tie system comprising:

a pair of parallel, spaced-apart foam plastic sheets, each formed of a numerous panels that are engaged together edge-to-edge to form a sheet;

a poured and cured in-place concrete core filling the space between the sheets to form a composite, plastic-concrete-plastic construction;

aligned pockets formed in at least some of the engaged edges of adjacent panels, with each pocket having an elongated, substantially uniform width, open slot formed through the wall surface into the interior of the pocket and facing towards the opposing panel;

ties for interconnecting and immobilizing the panels and the sheets during the pouring and curing of the concrete, with said ties each comprising a pair of elongated, thin, rigid sheet metal plates that are sized and shaped to snugly fit into a pair of aligned edge pockets;

each plate being bent into a central, narrow, channel-shaped, raised embossment extending out of the plane of the plate, with the embossment being sized and shaped to snugly fit within, and to be exposed through, the aligned slots of its respective aligned pockets;

and a pair of thin, narrow sheet metal strips extending between each pair of plates, with the opposite ends of the strips being connected to their respective plates;

wherein the tie members rigidly hold the panels in position prior to and during the pouring of the concrete, thereby forming a casting mold for the concrete, and mechanically fasten the panels and concrete core together.

2. A wall construction as defined in claim 1, and the opposite end portions of each of the strips being bent downwardly so that the strips form a U-shape whose elgs are at right angle to the plane of the body of their strips, and with each of the legs extending through a corresponding slot formed through its respective plate embossment so that the legs are arranged parallel to and engage the surfaces of the embossments of their plates;

and fastener means locking the legs to their respective plates.

3. A wall construction as defined in claim 2, and each plate having flattened loops, struck out of their central embossments and extending inwardly of the plate, that is, towards the opposite plate, to form narrow slots at the upper and lower ends of the loops for receiving the legs of their adjacent strips;

and said legs being secured to their plates by means of a mechanical fastener which interlocks the respective legs and the portions of the plate loops which the legs overlie.

4. A wall construction as defined in claim 3, and said strips being formed of sheet metal which is bent into a U-shaped cross-section along the lengths of the strips.

5. A system as defined in claim 4, and wherein the bases forming the U-shaped, in cross-section, strips are provided with elongated openings through which the concrete may flow during pouring for interlocking the strips to the concrete along the length of the strips.

6. A system as defined in claim 1, and each of said strips being twisted 360° a number of times along its length.

7. A wall construction as defined in claim 1, and with the embossment of each plate having pre-punched strike-out tooth-forming portions which are separated from their adjacent plate embossment portions except for an integral hinge-forming portion, with the tooth-forming portions normally being in the plane of its embossment, but being manually bendable at an angle to the plates outwardly for embedding into the adjacent panel portions to thereby interlock the plates to their respective panel portions to prevent relative movement between the plates and panels during pouring of the concrete.

8. A tie system for interconnecting spaced-apart parallel sheets that are formed of numerous edge-to-edge interconnected plastic panels for pouring in place and curing a concrete core between the sheets to produce a composite, insulated wall construction, and with the panels having pockets formed in their edges, which pockets have open ends in alignment with pockets in the edges of adjacent panels, and also, have open, slotted sides which open towards their opposing panel, comprising:

a pair of elongated, parallel, rigid, thin sheet metal plates that are interconnected by a number of tie strips extending between them and spanning the space between the parallel sheets;

said plates being sized and shaped to snugly fit into the open end, slotted side, aligned pockets formed in adjacent edge portions of adjacent panels, and said plates each being bent along its center into a U-shaped in cross-section embossment, extending along the length of the plate, with the embossment being sized to snugly fit within the open slots of the slotted sides of a pair of aligned pockets and being exposed at the interfaces of their respective panels;

each tie strip being formed of a narrow, elongated strip of sheet metal, having its opposite end portions bent into legs which are at right angles to the initial plane of the strips;

each of the legs extending through a slot formed in its respective plate, so that the legs are parallel to the surfaces of the plate and the body of each of the strips is perpendicular to the surfaces of the plate;

and metal fastener means interconnecting the overlapped legs and plate surface portions for mechanically securing them together;

whereby the ties rigidly secure together the parallel sheets and hold their panels against movement caused by hydrostatic pressure during casting of the concrete while producing a composite concrete-plastic panel wall construction.

9. A tie system as defined in claim 8, and each plate having flattened loops, struck out of their central embossments and extending inwardly of the plate, that is, towards the opposite plate, to form narrow slots at the upper and lower ends of the loops for receiving the legs of their adjacent strips, and said legs being secured to their plates by means of a mechanical fastener which interlocks the legs and the portions of the plate loops which the legs overlie.

10. A tie system as defined in claim 9, and said mechanical fasteners comprising indentations struck out of the loops for engaging struck out openings formed in the portions of the tie legs which overlap the loops to thereby mechanically interlock the legs to the loops.

11. A tie system as defined in claim 10, and said strips being formed of flat sheet metal which is bent into a U-shaped cross-section along the lengths of strips.

12. A tie system as defined in claim 8, and wherein each of said strips is twisted 360° a number of times along its length.

13. A tie system as defined in claim 8, and including each plate embossment portion being formed with integral teeth for embedding within adjacent surface portions of their pockets, with such teeth being formed of pre-punched, knock-out tabs that are defined by severing the tabs from the plate except for an integral hinge-forming portion so that the tooth-forming tabs are normally in the plane of the base of the embossment, but can be manually bent at an angle to the plate for embedding into the adjacent pocket portions.

* * * * *